United States Patent [19]

Worth

[11] Patent Number: 4,905,347

[45] Date of Patent: Mar. 6, 1990

[54] REMOVABLE TORQUE ROD ASSEMBLY FOR SELF-CLOSING DOOR

[76] Inventor: Franz L. Worth, 12410 McLennan, Granada Hills, Calif. 91344

[21] Appl. No.: 237,133

[22] Filed: Aug. 26, 1988

[51] Int. Cl.[4] ..... E05F 1/08

[52] U.S. Cl. ..... 16/308; 16/75

[58] Field of Search ..... 16/308, 75, 280

[56] References Cited

U.S. PATENT DOCUMENTS

| | | | |
|---|---|---|---|
| 50,411 | 10/1865 | Young et al. . | |
| 72,449 | 12/1867 | Burnham | 16/75 |
| 132,710 | 11/1872 | Buckman, Jr. | 16/75 |
| 962,426 | 6/1910 | Hansen . | |
| 1,173,408 | 2/1916 | Barnes | 16/75 |
| 2,676,864 | 4/1954 | Townsend | 16/75 |
| 2,878,531 | 3/1959 | Benham . | |
| 2,934,784 | 5/1960 | Price, Jr. et al. . | |
| 3,022,536 | 2/1962 | Floehr | 16/75 |
| 3,109,194 | 11/1963 | Ray | 16/75 |
| 3,311,946 | 4/1967 | Crankshaw | 16/308 |
| 3,331,159 | 7/1967 | Cooke et al. . | |
| 3,339,225 | 9/1967 | Booth | 16/308 |
| 3,390,418 | 7/1968 | Sheridan . | |
| 3,507,074 | 4/1970 | Gallegos . | |
| 4,158,271 | 6/1979 | Barry | 16/75 |
| 4,223,482 | 9/1980 | Barroero et al. . | |
| 4,671,582 | 6/1987 | Stromquist et al. | 16/93 R |
| 4,696,078 | 9/1987 | Stromquist | 16/308 |

FOREIGN PATENT DOCUMENTS

| | | | |
|---|---|---|---|
| 9795 | 8/1879 | Fed. Rep. of Germany | 16/75 |
| 1044317 | 9/1966 | United Kingdom . | |

*Primary Examiner*—Nicholas P. Godici

*Assistant Examiner*—Carmine Cuda

[57] ABSTRACT

A removable torque rod assembly for a self-closing door which may be easily installed on a door and an anchoring device mounted to an underlying door frame. The torque rod assembly may be used for either a left- or right-handed door. The assembly uses a torque rod located inside a metal sleeve having the sleeve crimped or attached to or otherwise made integral with the rod at its top end so that the rod and sleeve act together at the top end. The lower end of the torque rod passes through a bushing attached to the sleeve and through a bushing cap surrounding the bushing. A resilient O-ring fits into an annular groove in the bushing. The torque rod assembly is installed on the door by forcing the O-ring past an aperture in the door so that the O-ring holds the assembly on the door and a head of the bushing mates with the aperture in the door. The lower end of the torque rod assembly is then mounted in an anchoring device which keeps the lower end of the rod from rotating. The upper end of the torque rod is not attached to the door or frame and is a free end. The torque rod assembly may be removed from the door by lifting the door in order to dismount the lower end of the assembly from the anchoring device and then pushing the lower end of the assembly downward until the O-ring slips free of the aperture in the door.

19 Claims, 2 Drawing Sheets

REMOVABLE TORQUE ROD ASSEMBLY FOR SELF-CLOSING DOOR

BACKGROUND OF THE INVENTION

The present invention relates generally to torque rods used for self-closing doors and, more particularly, to a removable torque rod assembly which may be easily installed on a door and an anchoring device mounted to an underlying door frame in order to provide a selfclosing door, and may be later removed from the door.

In the past, torque rod assemblies have been used to provide door springs for the purpose of keeping doors shut. For example, torque rods having one end connected to a door frame and the other end thereof connected to a door in order to provide sufficient biasing force to close the door after it is opened and then released are disclosed in U.S. Pat. Nos. 4,158,271, issued to Barry on June 19, 1979; 962,426, issued to Hansen on June 28, 1910; and 72,449, issued to Burnham on Dec. 24, 1867. U.S. Pat. No. 1,173,408, issued to Barnes on Feb. 29, 1986, describes a gate having a torque rod installed inside a pivot rail of the gate with the upper end of the rod connected to a block attached to the inside of the rail and the lower end of the rod mounted (unable to rotate) on a member connected to a post adjacent the rail. Torque rods located inside sleeves, having one end coupled or connected to a door and the other end connected to a support are shown in U.S. Pat. Nos. 3,109,194, issued to Ray on Nov. 5, 1963; and 132,710, issued to Buckman, Jr. on Nov. 5, 1972.

U.S. Pat. No. 4,696,078, issued to Stromquist on Sept. 29, 1987, describes a torque rod inside a sleeve having its upper end connected to a door and its lower end mounted on an anchoring device connected to an underlying door frame. As such, the lower end of the torque rod is prevented from rotating by the anchoring device while the upper end is connected to the door and rotates with the door (inside the sleeve) building up torsional forces on the rod which force the door to return to its closed portion. Finally, other torsion devices, hinges or assemblies used to keep doors shut are described in U.S. Pat. Nos. 3,022,536, issued to Floehr on Feb. 27, 1962; 2,676,864, issued to Townsend on Apr. 27, 1954; and 50,411, issued to Young, et al. on Oct. 10, 1865.

All of the above patents disclose torque rod or other spring assemblies which are permanently attached to a door and its corresponding door frame or supporting structure. As a result, the assemblies cannot be easily removed from the door or frame and reused or replaced without causing damage to the door or frame, or expending considerable time, effort or expense to remove the assemblies. In addition, most of the designs disclosed in the above-identified patents are complicated and expensive to manufacture. As such, there is a need for an inexpensive torque rod assembly for use with a self-closing door which may be easily installed on a door and an anchoring device connected to a door frame, and may be subsequently removed from the door and replaced or reused.

SUMMARY OF THE INVENTION

It is an object of the invention to provide a removable torque rod assembly for a self-closing door which may be easily installed on a door and an anchoring device connected to an underlying door frame, and later removed from the door.

It is another object of this invention to provide a removable torque rod assembly for a self-closing door that is simple in design and inexpensive to manufacture.

It is still another object of the invention to provide a removable torque and assembly for a self-closing closing door that does not have any parts thereof permanently attached to the door or its corresponding door frame.

It is still another object of this invention to provide a removable torque rod assembly for a self-closing door that has one free end which is not attached to the door or its corresponding door frame after the assembly is installed.

These and other objects and advantages are attained by a removable torque rod assembly for a self-closing door which may be easily installed on a door and an anchoring device mounted to an underlying door frame, and may be later removed from the door and reinstalled on the same door or reused for another self-closing door. The torque rod assembly may be used for either a left- or right-handed door. The assembly uses a torque rod located inside a metal sleeve with the sleeve crimped or attached to or otherwise made integral with the rod at its top end so that the rod and sleeve act together at the top end. The torque rod below the crimped portion is not attached to the sleeve and twists inside the sleeve relative to the sleeve. The lower end of the torque rod passes through a cylindrical bore in a bushing attached to the sleeve and through an aperture in a bushing cap fitting around and rotatably engaging a collar of the bushing. A nut is integrally attached to the lower end of the torque rod and a resilient O-ring fits into an annular groove in the bushing.

The torque rod assembly is installed on the door by forcing the O-ring past an aperture in the door having a hexagonal or any non-circular shape such as a square shape, octagonal shape, etc. so that the O-ring holds the assembly on the door and a head of the bushing mates with the aperture in the door, causing the bushing and sleeve to rotate with the door. The lower end of the torque rod assembly is then mounted in an anchoring device which engages the nut at the lower end of the torque rod preventing the bottom end of the rod from rotating. The upper end of the torque rod assembly is not attached to the door or frame and is a free end. As the door swings open, it causes the sleeve to rotate and the torque rod to twist inside the sleeve relative to the sleeve. As a result, torsional forces built up in the torque rod urge the door shut. The torque rod assembly may be removed from the door by lifting the door in order to dismount the lower end of the assembly from the anchoring device and then pushing the lower end of the assembly downward until the O-ring slips free of the door past the aperture in the door.

The torque rod assembly may be reinstalled on the same door or installed on another self-closing door by pushing the O-ring upward past the aperture in the door and mounting the lower end of the assembly on an anchoring device as explained above. As a result, the torque rod assembly may be reused as often as desired and may be used for either a left- or right-handed door.

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventor for carrying out his invention in a commercial environment although it should be understood that various modifications can be accomplished within the parameters of the present invention.

Figure 1:
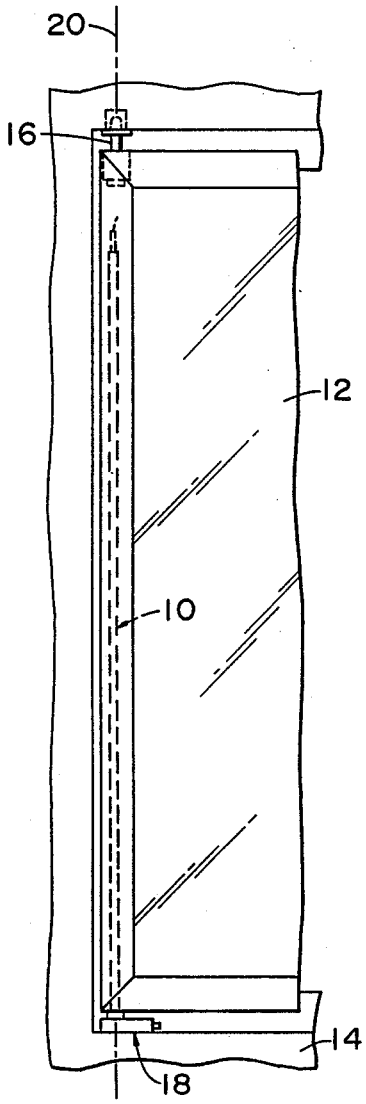
FIG. 1 is an elevational view of a door, door frame and removable torque rod assembly illustrating the principles of the present invention showing the assembly installed on a door with the bottom end of the assembly mounted on an anchoring device.
Figure 2:
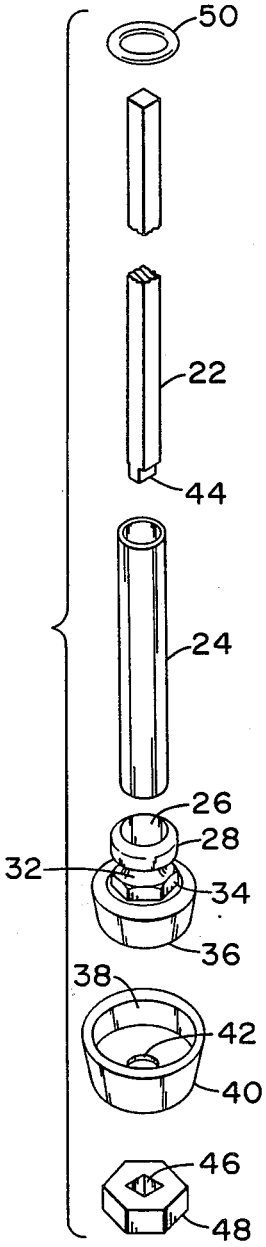
FIG. 2 is an exploded perspective view of the removable torque rod assembly of FIG. 1.

Referring to FIG. 1, a proposed embodiment of the removable torque rod assembly 10 of the present invention is shown installed on a door 12, such as a commercial glass-paned refrigerator door, and on its corresponding door frame 14. A conventional door hinge assembly 16 is located at the top of the frame 14 hinging a top portion of the door 12 to the frame 14. The lower end of the torque rod assembly 10 is mounted on an anchoring device 18 so that the door 12 has a pivot axis 20 as shown in FIG. 1 about which it swings open and shut with the door 12 having a top pivot point at hinge 16 and a bottom pivot point near device 18 where a lower end of the torque rod assembly 10 is engaged to device 18 as explained below. Note that the top of the torque rod assembly 10 is not attached to the door 12, and is a free end.

Figure 3:
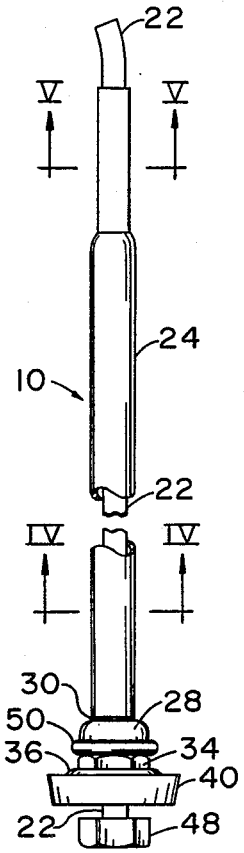
FIG. 3 is an elevational view of the removable torque rod assembly of FIG. 1.
Figure 4:
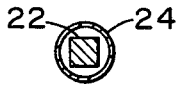
FIG. 4 is a cross-sectional view taken in the direction of arrows IV—IV in FIG. 3.
Figure 5:
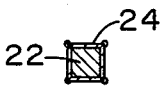
FIG. 5 is a cross-sectional view taken in the direction of arrows V—V of FIG. 3.

FIGS. 2 through 5 show the removable torque rod assembly 10 in more detail. The assembly 10 uses a torque rod 22, preferably made out of spring steel of high fatigue resistance which retains its torsional resiliency, located inside a tube or sleeve 24. The sleeve 24 is preferably metal tubing. The top end of the sleeve 24 is crimped, welded or otherwise integrally attached to the top end of the torque rod 22 so that the rod 22 and sleeve 24 act or move together at the top end. FIGS. 3 and 5 show the sleeve 24 crimped to the rod 22 at the top of the sleeve 24. A cap (not shown) may be placed over the portion of the rod 22 extending out of the top of the sleeve 24 if desired. The remaining portion of the rod 22 below the crimped portion of sleeve 24 is free to twist inside the sleeve 24 relative to the sleeve 24 (see FIG. 4). However, as explained later, the lower end of the torque rod 22 is not free to twist or move. Note that torque rod 22 is shown having a square cross-section in FIG. 4. However, a flat, round or other type rod 22 may be used having any desirable cross-section.

Figure 6:
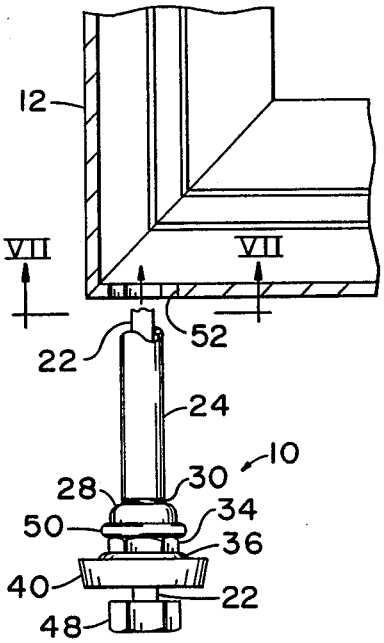
FIG. 6 is an elevational view in partial cross-section of bottom portions of the removable torque rod assembly and door of FIG. 1 showing how the assembly may be moved upward engaging a hexagonal aperture in the door.

The lower end of sleeve 24 engages a cylindrically-shaped bore 26 passing through a member or bushing 28 and is welded, soldered or otherwise attached to the bushing 28 at point 30 (see FIGS. 3 and 6). Bushing 28 has an annular groove 32 therein located above hexagonal surfaces of bushing head 34 and collar 36 preferably formed integrally as part of the bushing 28. However, head 34 and collar 36 may be welded or otherwise attached to each other instead of formed integrally if desired. The bushing collar 36 engages a socket 38 in a bushing cap 40 having an aperture 42 at the bottom of the socket 38 so that the cap 40 rotatably engages the collar 36. The lower end of the torque rod 22 passes down the sleeve 24 through bushing 28 and through aperture 42, allowing the bushing cap 40 to rotate about the rod 22 and downwardly extending portion 44 (see FIG. 2) of the rod 22 with a reduced cross-section to be press fitted into an aperture 46 in a nut 48 located below the bushing cap 40. An O-ring 50, preferably made out of rubber, completes the torque rod assembly 10 and fits into the annular groove 32 in the bushing 28 as shown in FIG. 3 for the purpose of installing the assembly 10 on the door 12 as explained later. Note that any other resilient-type O-ring 50 may be used instead of a rubber ring.

Figure 7:
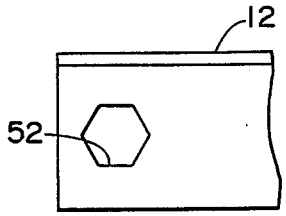
FIG. 7 is a bottom plan view taken in the direction of arrows VII—VII of FIG. 6 showing the hexagonal aperture.
Figure 8:
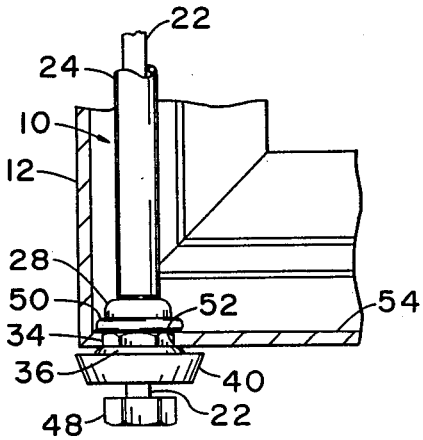
FIG. 8 is a view taken similar to FIG. 6 showing the removable torque rod assembly installed on the door.

FIG. 6 shows how the removable torque rod assembly 10 may be moved upward engaging a hexagonal aperture 52 (see FIG. 7) in the door 12 for the purpose of installing the assembly on the door 12. The assembly 10 is pushed upward until the rubber O-ring 50 is forced past aperture 52 and rests on top of surface 54 of the door 12 as shown in FIG. 8 so that the O-ring 50 holds the assembly 10 in place, installed on the door 12. Note that the upper end of the torque rod assembly 10 remains free and is not attached to either the door 12 or door frame 14 when the assembly 10 is installed on the door 12. When the torque rod assembly 10 is installed on the door as shown in FIG. 8, the hexagonal head 34 mates with hexagonal aperture 52 in such a way that the torque rod assembly 10 as installed at the bottom of the door 12 does not rotate with respect to the door 12, but is able to rotate with the door 12 when the torque rod 22 is twisted as discussed below. It is important to note that any shape aperture may be used instead of the hexagonal aperture 52, for example, any non-circular aperture, such as a square aperture, octagonal aperture, etc. Similarly, any shape head other than the hexagonal head 34 may be used (any non-circular-shaped head, such as a square head, octagonal head, etc.) so long as the head 34 is capable of mating with aperture 52 to prevent rotation of the torque rod assembly 10 with respect to the door 12 when installed on the door 12 as explained above.

Figure 9:
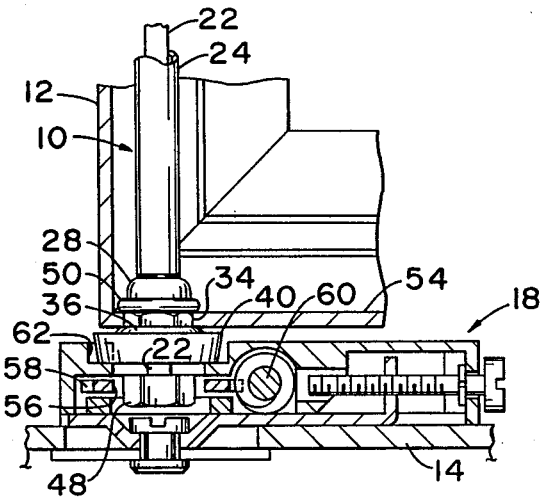
FIG. 9 is a partial cross sectional view of bottom portions of the removable torque rod assembly and door of FIG. 1 and of an anchoring device showing the assembly installed on the door and mounted on the anchoring device.

The lower end of the torque rod 22 extends below the bushing cap 40 and is attached to nut 48, which facilitates mounting of the lower end of the torque rod assembly 10 on an anchoring device 18 attached to the door frame 14 as shown in FIG. 9. Any conventional type of anchoring device 18 may be used with the assembly 10 that keeps the bottom end of the torque bar 22 from rotating as the door 12 swings open and shut. Preferably, an anchoring device 18 is used such as that described in U.S. Pat. No. 4,696,078, issued to Stromquist on Sept. 29, 1987, the disclosure of which is hereby incorporated by reference. The anchoring device disclosed in this patent is shown in FIG. 9, and all descriptions contained herein of how the lower end of the torque rod assembly 10 works in conjunction with the anchoring device 18 will refer to parts of the device disclosed in the above patent. However, it is intended that the torque rod assembly 10 may be used with any other now known or later developed anchoring devices and, therefore, the lower end of the assembly 10 is intended to be able to interact with different parts of such other devices to achieve the same results described herein. In addition, the lower end of the assembly 10 may be removably and directly connected to the door frame 14 without the use of an anchoring device 18 using any desirable means of connection that prevents the lower end from moving or rotating any other The nut 48 may be a hexagonal nut or any other desirable type nut as long as the nut 48 is able to mate with engaging surfaces of an aperture 56 in a worm wheel 58 used in the device 18 to prevent rotation of the nut 48 when the door swings open and shuts. Worm wheel 58 engages worm screw 60 which is used to adjust the amount of initial torsion applied to the torque rod 22 and allows for later adjustments of the torque rod 22. The bushing cap 40 fits in socket 62 at the top of the device 18 as shown on FIG. 9. The bushing cap 40 is made out of any hard, smooth material such as plastic, or the like, that will reduce friction between the relative rotating surfaces between the cap 40 and the socket 62 and bushing collar 36 when the door 12 swings open and shut.

When the torque rod assembly 10 is installed as shown in FIG. 9, the door rests on top of the bushing collar 36 and the weight of the door 12 forces bushings cap 40 into socket 62. As the door 12 swings open and shut about pivot axis 20 (see FIG. 1), nut 48 is held stationary by wheel 58 and the door 12 causes the bushing 28 and sleeve 24 to rotate relative to stationary nut 48 due to aperture 52 which mates with head 34 and causes the bushing 28 and sleeve 24 to rotate with the door 12. While rotation is taking place, bushing cap 40, which is free to rotate about collar 36, helps to reduce friction, thereby facilitating rotation as explained above.

Due to torsional forces passing up the sleeve 24 to where the sleeve 24 is crimped to the top of the torque rod 22, rotation of the door 12 and sleeve 24 causes the torque rod 22 to twist about its longitudinal axis as a result of nut 48 being held stationary in the anchoring device 18. Because the torque rod 22 is twisted when the door 12 is opened, biasing forces are built up on the rod 22 urging the door 12 back to its closed position. Worm screw 60 may be used to turn nut 48 and preload the torque rod 22 with initial torsion, if desired, tending to urge the door 12 shut. Even though the upper end of the torque rod assembly 10 is a free end not attached to the door 12 or frame 14, the assembly 10 still operates to return the door 12 to its closed position unlike a conventional torque rod assembly which will not operate unless the top end of the torque rod used for the assembly is directly attached near the top of a door and to its corresponding door frame.

An important advantage of the torque rod assembly 10 of the present invention is derived from the features of the invention which allow the assembly 10 to be easily installed on a door 12 and mounted on an anchoring device 18 as described above, and then removed from the door 12 and reinstalled on the same door 12 or used for a different door. In addition, the torque rod assembly 10 may be used for either a left- or right-handed door. For example, aperture 52 is shown in FIGS. 4, 8 and 9 as being located in the lower left hand corner of the door 12. The door 12 can be fabricated so that it has a second aperture 52 at its upper left hand corner. As a result, the door 12 may be repositioned or turned upside down so that the second aperture is at the lower right hand corner of the repositioned door 12. The torque rod assembly 10 may then be used with an anchoring device 18 and the repositioned second aperture 52 at the lower right hand corner of the door 12 for a left-handed door 12. As such, the torque rod assembly 10 is "removable" in the true sense of the word, reusable and can be used with either a left- or right-handed door 12. Conventional torque rod assemblies have their upper ends attached to a door or frame rather than being free of the same, and removal of such conventional assemblies results in damage or considerable time and effort, or both. As such, these conventional torque rod assemblies cannot be considered removable and reusable assemblies like the torque rod assembly of the present invention.

The torque rod assembly 10 may be removed from the door 12 and anchoring device 18 by first lifting the door 12 to dismount the nut 48 and bushing cap 40 from the device 18, and then pushing the bottom of the torque rod assembly 10 downward until the resilient O-ring 50 forces (slips) past aperture 52 in the door 12, allowing the assembly 10 to be removed from the door 12. As such, the size and resilient material of O-ring 50 are selected to allow the O-ring 50 to be easily slipped past aperture 52 for purposes of installing or removing the torque rod assembly 10. In addition, the O-ring 50 may be replaced when it wears out by simply slipping it out of annular groove 32 and replacing it with another O-ring. After the torque rod assembly 10 has been removed, it may be easily reinstalled on the same door it was removed from or on another door by repeating the steps described above.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiment without departing from the spirit and scope of the invention.

I claim:

1. A removable torque rod assembly for a self-closing door, said door having an aperture therein and a corresponding door frame with an anchoring device mounted thereon, said assembly comprising:

an elongated sleeve;

a member fixedly attached to the bottom of said sleeve, said member having a bore passing therethrough, said member capable of removably engaging said aperture in said door so that relative movement between said member and said door is prevented;

a torque rod disposed inside said elongated sleeve and non-rotatably attached to said sleeve near the top of said sleeve, said rod capable of twisting inside said sleeve relative to said sleeve below where said rod is attached to said sleeve, said rod passing through said bore in said member, said rod having an upper end that is a free end and a lower end that is mounted on said anchoring device, said anchoring device preventing said lower end from rotating, said sleeve capable of passing through said aperture for installation of said assembly on said door and for removal of the assembly from the door, said torque rod biasing said door toward a closed position when said assembly is installed on said door and after said door is opened; and resilient means removably engaged to said member for removably installing said torque rod assembly on said door.

2. The removable torque rod assembly of claim 1 wherein said resilient means is a ring.

3. The removable torque rod assembly of claim 2 wherein said resilient ring means includes a resilient ring removably engaging an annular groove in said member, said ring capable of being forced upward past said aperture in said door in order to install said assembly on said door, and capable of being forced downward out of said aperture in said door in order to remove said assembly from said door.

4. The removable torque rod assembly of claim 3 further comprising a cap fitting around and rotatably engaging a collar on said member, said cap removably engaging a socket in said anchoring device, said torque rod passing through an aperture in said cap so that said cap rotates about said rod.

5. The removable torque rod assembly of claim 4 further comprising a nut attached to said lower end of said torque rod, said nut removably engaging said anchoring device in order to prevent rotation of said lower end of said torque rod.

6. The removable torque rod assembly of claim 2 wherein said resilient ring is made out of rubber, said elongated sleeve is metal tubing and said torque rod is made out of spring steel.

7. The removable torque rod assembly of claim 6 wherein said torque rod has a square cross-section and said elongated sleeve is crimped to said rod near said top of said sleeve.

8. The removable torque rod assembly of claim 1 wherein said member has a head capable of removably engaging said aperture in said door.

9. The removable torque rod assembly of claim 8 wherein said head and said aperture in said door have mating hexagonal surfaces.

10. A removable torque rod assembly for a self-closing door, said door having an aperture therein and a corresponding door frame with an anchoring device mounted thereon, said assembly comprising:

an elongated sleeve;

a bushing attached to the bottom of said sleeve, said bushing having an aperture passing therethrough, an annular groove therein and a bushing head;

a resilient ring engaging said annular groove in said bushing; and a torque rod disposed inside said elongated sleeve and integrally attached to said sleeve near the top of said sleeve, said rod capable of twisting inside said sleeve relative to said sleeve below where said rod is attached to said sleeve, said rod passing through said aperture in said bushing, said rod having an upper end that is a free end and a lower end that is mounted on said anchoring device, said anchoring device preventing said lower end from rotating, said torque rod assembly being installed on said door so that (a) said bushing head removably engages and mates with said aperture of said door preventing relative rotation between said head and said door, (b) said resilient ring is located above said aperture in said door preventing said bushing head from disengaging from said aperture in said door, and (c) said resilient ring is capable of being forced upward past said aperture in said door in order to install said assembly on said door and capable of being forced downward out of said aperture in said door in order to remove said assembly from said door, said torque rod urging said door toward a closed position when said assembly is installed on said door and after said door is opened.

11. The removable torque rod assembly of claim 10 further comprising a bushing cap fitting around and rotatably engaging a collar on said bushing, said bushing cap having an aperture therein, said torque rod passing through said aperture in said bushing cap so that said bushing cap rotates about said rod.

12. The removable torque rod assembly of claim 11 further comprising a nut attached to said lower end of said torque rod, said nut removably engaging said anchoring device in order to prevent rotation of said lower end of said torque rod.

13. The removable torque rod assembly of claim 12 wherein said bushing head and said aperture in said door have mating hexagonal surfaces.

14. The removable torque rod assembly of claim 13 wherein said resilient ring is made out of rubber, said elongated sleeve is metal tubing and said torque rod is made out of spring steel.

15. A removable torque rod assembly for a self-closing door, said door having an aperture therein and a corresponding door frame with an anchoring device mounted thereon, said assembly comprising:

an elongated sleeve;

a bushing attached to the bottom of said sleeve, said bushing having an aperture passing therethrough, a bushing head, an annular groove in said bushing above said bushing head, and a collar;

a resilient ring engaging said annular groove in said bushing;

a bushing cap fitting around and rotatably engaging said collar, said bushing cap having an aperture therein;

a torque rod disposed inside said elongated sleeve and integrally attached to said sleeve near the top of said sleeve, said rod capable of twisting inside said sleeve relative to said sleeve below where said rod is attached to said sleeve, said rod passing through and rotatably engaging said aperture in said bushing, and said aperture in said bushing cap, said torque rod having an upper end that is a free end and a lower end that is mounted on said anchoring device; and a nut attached to said lower end of said torque rod, said nut removably engaging said anchoring device in order to prevent rotation of said lower end of said torque rod, said bushing cap removably and rotatably engaging a socket in said anchoring device, said bushing head removably engaging and mating with said aperture in said door in order to prevent rotation between said door and said bushing hed, said torque rod assembly removably held to said door by said resilient ring after said ring has been pushed upward through said aperture in said door, said torque rod assembly capable of being removed from said door by pulling said ring downward out of said aperture in said door, said torque rod biasing said door toward a closed portion when said assembly is mounted on said door and said door is opened.

16. The removable torque rod assembly of claim 15 wherein said bushing head and said aperture in said door have mating hexagonal surfaces.

17. The removable torque rod assembly of claim 16 wherein said resilient ring is a rubber O-ring, said elongated sleeve is metal tubing, and said torque rod is made out of spring steel.

18. The removable torque rod assembly of claim 17 wherein said torque rod has a square cross-section and said elongated sleeve is crimped to said rod near said top of said sleeve, said door rests on top of said collar when said torque rod assembly is mounted on said door.

19. The removable torque rod assembly of claim 15 wherein said door has two apertures therein, one of said apertures at the upper left hand corner of said door and the other of said apertures at the lower left hand corner of said door, said torque rod assembly capable of being used with said door, said door apertures and said anchoring device to selectively provide a left-handed and a right-handed door by selectively repositioning said door so that one of said door apertures is selectively located at said lower left hand corner of said door for said right-handed door and the other of said door apertures is selectively located at said lower right-handed corner of said door for said left-handed door.

* * * * *